US005524919A

United States Patent [19]

Sedlmair

[11] Patent Number: 5,524,919

[45] Date of Patent: Jun. 11, 1996

[54] BINDING ADAPTER PLATE

[75] Inventor: Gerhard Sedlmair, Farchant, Germany

[73] Assignee: Marker Deutschland GmbH, Germany

[21] Appl. No.: 253,502

[22] Filed: Jun. 3, 1994

[30] Foreign Application Priority Data

Jun. 3, 1993 [DE] Germany ..... 43 18 513.4

[51] Int. Cl.[6] ..... A63C 9/08

[52] U.S. Cl. ..... 280/607; 280/617; 280/618

[58] Field of Search ..... 280/607, 602, 280/618, 11.14, 617

[56] References Cited

U.S. PATENT DOCUMENTS

| | | | |
|---|---|---|---|
| 3,797,844 | 3/1974 | Smolka et al. | 280/607 |
| 5,211,418 | 5/1993 | Scherubl | 280/602 |
| 5,395,132 | 3/1995 | Abondance et al. | 280/607 |
| 5,397,150 | 3/1995 | Commier et al. | 280/607 |
| 5,413,371 | 5/1995 | Trimble | 280/607 |

FOREIGN PATENT DOCUMENTS

| | | | |
|---|---|---|---|
| 4112299 | 12/1991 | Germany | 280/607 |

*Primary Examiner*—Richard M. Camby
*Attorney, Agent, or Firm*—D. Peter Hochberg; Mark Kusner; Michael Jaffe

[57] ABSTRACT

The invention relates to binding adapter plate for intermediate placement between the front and/or rear jaws of a ski binding and a ski. The binding adapter plate includes holes in the form of cylindrical bores which are dimensioned to receive fasteners for attaching the binding adapter plate and ski binding to the ski. An inner portion of the plate being movable relative to an outer frame portion of the plate when the ski flexes to relieve stress.

14 Claims, 4 Drawing Sheets

BINDING ADAPTER PLATE

FIELD OF THE INVENTION

The invention relates generally to a binding adapter plate for the toe and/or heel piece of a ski binding. More particularly, the present invention relates to a binding adapter plate which reduces the stress on the binding attachment screws caused by the flexing or bending of the ski, and which allows the ski binding to be mounted higher above the surface of the ski.

BACKGROUND OF THE INVENTION

French patent publication No. 2,669,833 discloses the basic principle of arranging a binding adapter plate as an intermediate layer between the front jaws or rear jaws of a ski binding and the surface of a ski. Between the respective binding adapter plates in the front jaw part and in the rear jaw part a portion of the ski is not covered over by the binding adapter plate. Such known binding adapters plates are essentially solid plate parts, which may have recesses in order to save weight. In order to render possible adaptation of known binding adapter plates to the flexibility of the ski, several transversely extending notches are provided in the surface of the binding adapter plates. In the case of prior art binding adapter plates, the attachment screws, which extend through the intermediate arranged binding adapter plate to attach the ski binding to the ski, are subjected to an alternate loading effect due to flexing by the ski. The load on the attachment screws increases with the increase in the length and thickness of the binding adapter plates.

SUMMARY OF THE INVENTION

According to one aspect of the present invention there is provided a binding adapter device for providing an intermediate layer between a ski and a ski binding mounted on the ski. The binding adapter plate is comprised of a relatively stiff outer structure and a relatively flexible inner structure, and connecting means for connecting said outer structure to the inner structure. The connecting means allows the outer structure to move relative to the inner structure as the binding adapter device is flexed in response to flexing of the ski, to relieve stress applied by the ski to the device.

According to one aspect of the present invention there is provided a binding adapter device for providing an intermediate layer between a ski binding and the surface of a ski comprised of a relatively stiff outer structure having a frame section and a generally planar section, said generally planar section having at least one hole for receiving a fastener for fastening said adapter device to said ski, and a relatively flexible inner structure. The inner structure is comprised of a tongue means integrally connected to said generally planar section and having at least one hole for receiving a fastener for fastening said binding adapter plate to said ski, said inner structure being movable relative to said outer structure as the binding adapter plate is flexed in response to the flexing of the ski, to reduce stress applied by the ski to the plate.

According to another aspect of the present invention there is provided a binding adapter plate for providing an intermediate layer between a ski binding and the surface of a ski, said binding adapter plate comprised of a relatively stiff outer portion for contributing to support the binding of the ski, and a relatively flexible inner portion. The inner portion is comprised of a plurality of ribs dimensioned to have a height greater than their width, at least one strip dimensioned to have a width greater than its height, and a plurality of holes for receiving fasteners for fastening said binding adapter plate to said ski. The inner portion being movable relative to the outer portion as the binding adapter plate is flexed in response to the flexing of the ski to relieve stress applied by the ski to the plate.

According to another version of the present invention there is provided a binding adapter plate for providing an intermediate layer between a ski binding and a ski, said binding adapter plate comprised of a relatively stiff outer portion, and a relatively flexible inner portion formed generally of a lattice, said inner portion comprised of a lattice-like main body portion having at least one hole for receiving a fastener for fastening said binding adapter plate to said ski, and a lattice-like tongue means integrally connected to said main body portion and having at least one hole for receiving a fastener for fastening said binding adapter plate to said ski, said inner portion being movable relative to said outer portion as the binding adapter plate is flexed in response to the flexing of the ski to relieve stress applied by the ski to the device.

It is an object of the present invention to provide a binding adapter plate that minimizes the stress on fasteners extending through the binding adapter plate to attach the ski binding and binding adapter plate to the ski.

A still further object of the present invention is to provide a binding adapter plate having a relatively inflexible outer portion integrally connected to a relatively flexible inner portion which is in the form of a tongue.

Another object of the present invention is to provide a binding adapter plate having a relatively flexible inner portion connected via ribs to a relatively stiff outer portion.

Another object of the present invention is to provide a binding adapter plate constructed of a lightweight yet strong synthetic resin molding.

It is a further object of the present invention to provide a binding adapter plate that allows the ski binding to be mounted at a position higher above the ski.

It is another object of the present invention to provide a binding adapter plate which allows for improved control of a ski.

It is yet another object of the present invention to provide a binding adapter plate which allows a skier to pivot a ski at a greater angle along the longitudinal axis of the ski.

These and other objects of the invention will be apparent to those skilled in this art from the following detailed description of preferred embodiments of the invention.

DETAILED DESCRIPTION

Figure 1:
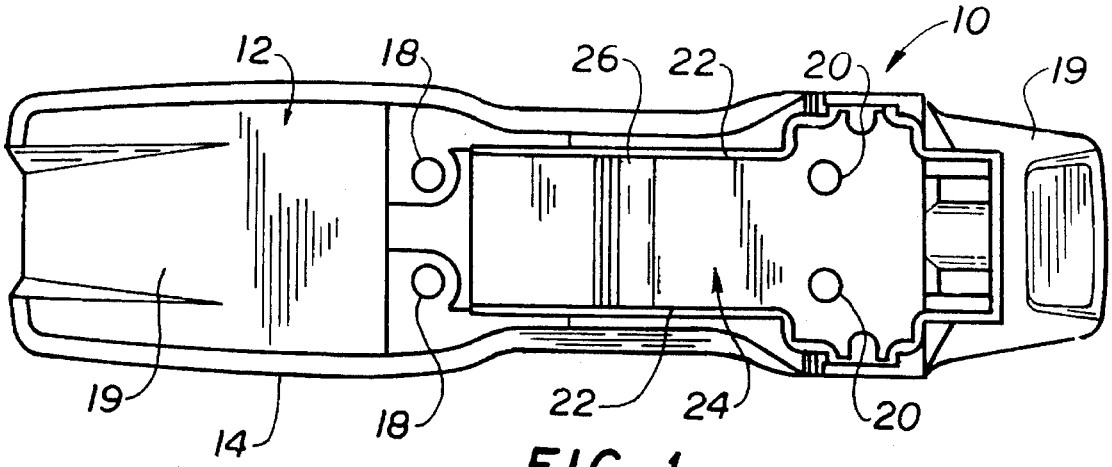
FIG. 1 is a top plan view of a first embodiment of a binding adapter plate in accordance with the present invention.

FIGS. 1 through 4 show a binding adapter plate or device 10 adapted for use in conjunction with a ski binding heel piece. In this respect, binding adapter plate 10 is positioned between the ski binding heel piece and the ski. Binding adapter plate 10 is comprised of a relatively flexible inner structure or portion 24 and an outer structure or portion 12, which is inflexible relative to the inner portion 24.

Outer portion 12 is comprised of a frame section 14 and a generally planar section 19. Frame section 14 includes lateral ribs that extend downward from the peripheral edge of generally planar section 19. Along a mid-section of the downward extending ribs a series of notches 15 are formed. Notches 15 allow the outer portion 12 to have some flexibility with respect to a ski on which the adapter plate 10 is attached. Generally planar section 19 is generally parallel to the ski. Reinforcing ribs 16 extend downward from and substantially perpendicular to the bottom surface of planar section 19. Ribs 16 have a height greater than their width. Generally planar section 19 also includes a pair of holes 18 in the form of cylindrical bores. Holes 18 are dimensioned to receive fasteners (e.g., attachment screws) which attach binding adapter plate 10 and a ski binding to a ski.

Figure 2:
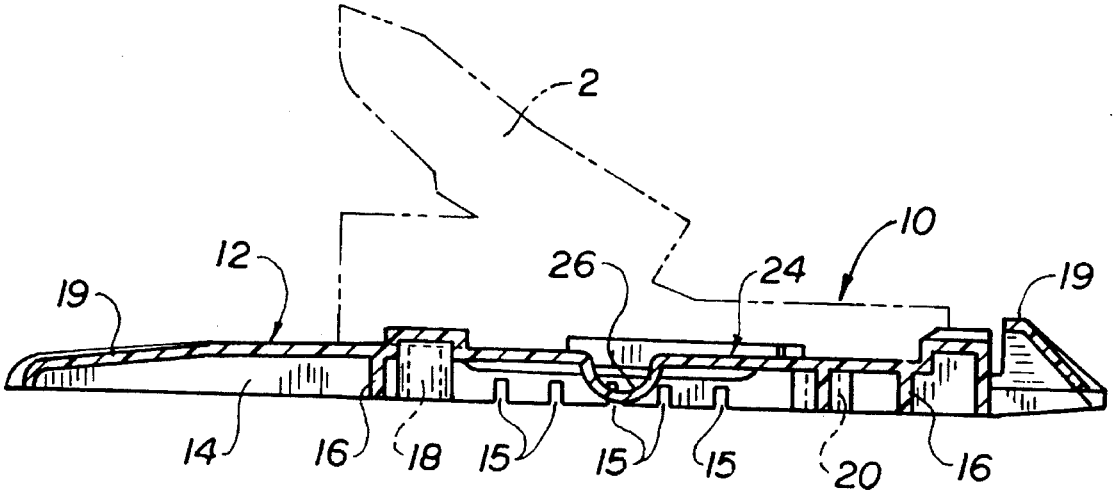
FIG. 2 is a longitudinal section taken through the binding adapter plate in accordance with FIG. 1 having a ski binding heel piece mounted thereon.
Figure 3:
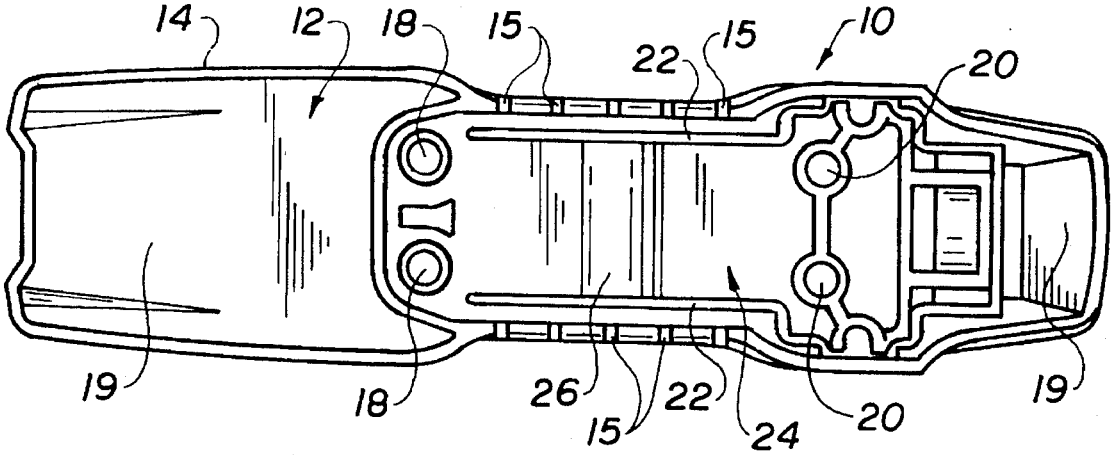
FIG. 3 is a bottom plan of the binding adapter in accordance with FIG. 1.

Inner portion 24 is comprised of a resilient tongue. The tongue includes a pair of holes 20 in the form of cylindrical bores. Holes 20 are dimensioned to receive fasteners (e.g., attachment screws) which attach binding adapter plate 10 and a ski binding to a ski. Reinforcing ribs 16 extend downward from and substantially perpendicular to the bottom surface of the tongue. Ribs 16 have a height greater than their width. The tongue is positioned within an opening 22 and is integrally connected to generally planar section 19 of outer portion 12. The longitudinal axis of the tongue is parallel to the longitudinal axis of binding adapter plate 10. A corrugation 26 extends width-wise across the tongue to provide additional means for the tongue to flex. It will be appreciated that corrugation 26 is not a necessary component of the invention, but is merely an additional means for providing flexibility. A ski binding heel piece 2 as mounted on adapter plate 10 is shown in FIG. 2.

Figure 4:
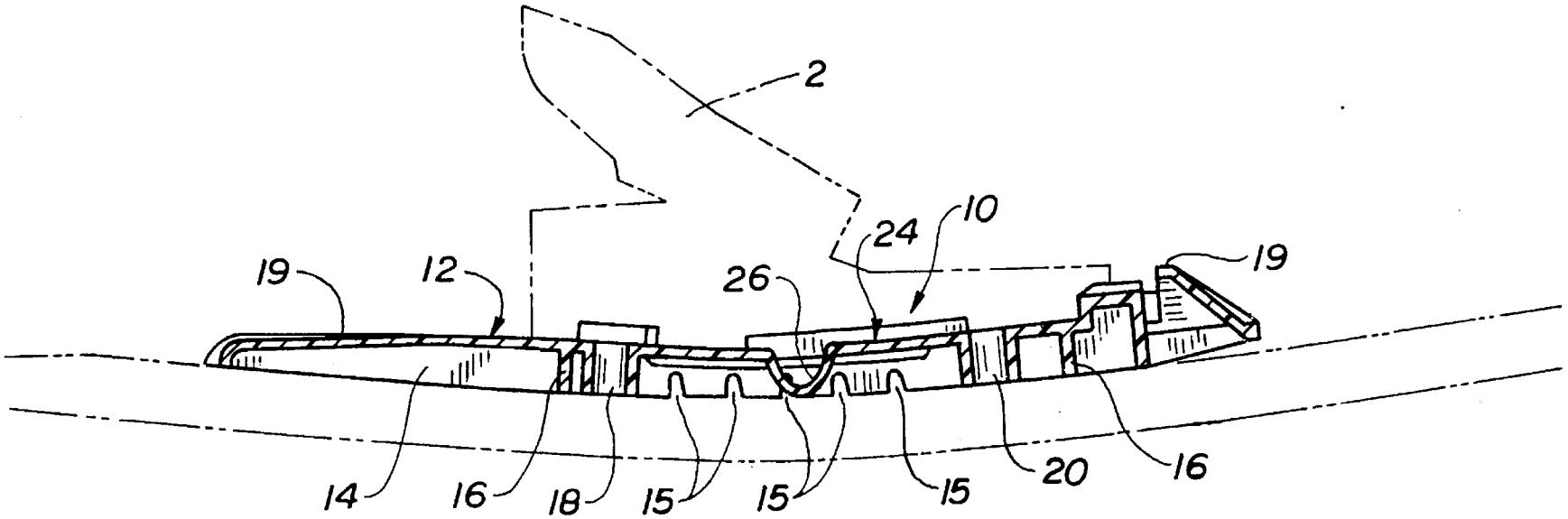
FIG. 4 is a diagrammatic longitudinal section of the binding adapter plate mounted upon a flexed ski.

FIG. 4 shows binding adapter plate 10 mounted upon a ski as the ski is flexed. In this respect, inner portion 24 moves relative to outer portion 12. This occurs since outer portion 12 is relatively stiff and inflexible and inner portion 24 is relatively flexible. As inner portion 24 moves relative to outer portion 12, holes 18 will move closer to holes 20, thus reducing the distance between the holes. In addition, corrugation 26 provides additional means for allowing the inner portion 24 to move relative to outer portion 12 when the ski flexes. This relative movement of the inner and outer portions prevents stress on fasteners attaching the adapter plate 10 and ski binding 2 to the ski.

Figure 5:
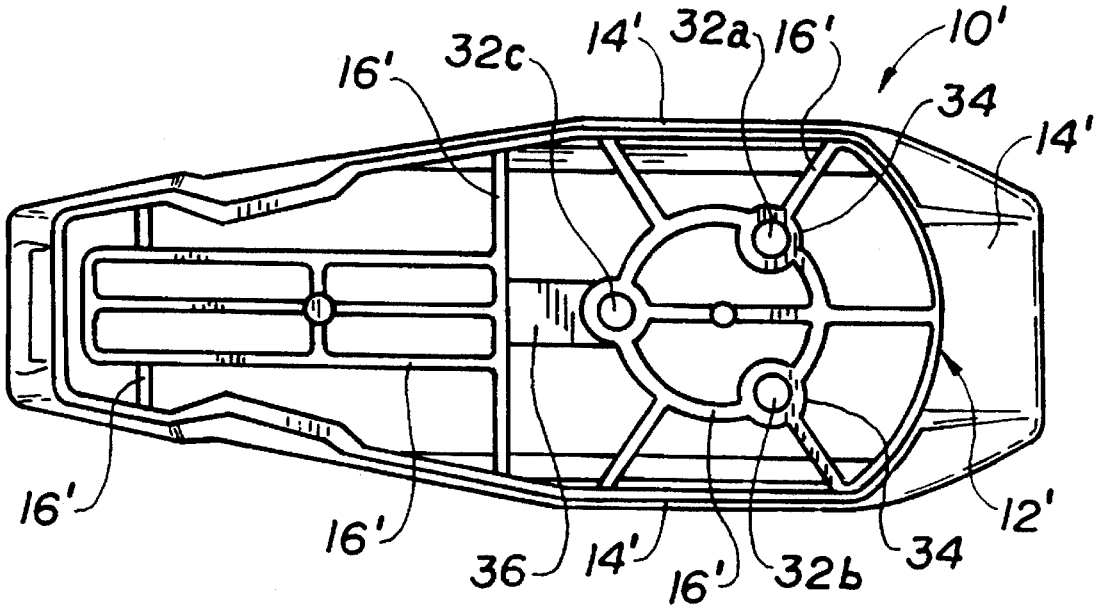
FIG. 5 is a top plan view of a second embodiment of a binding adapter plate in accordance with the present invention.
Figure 6:
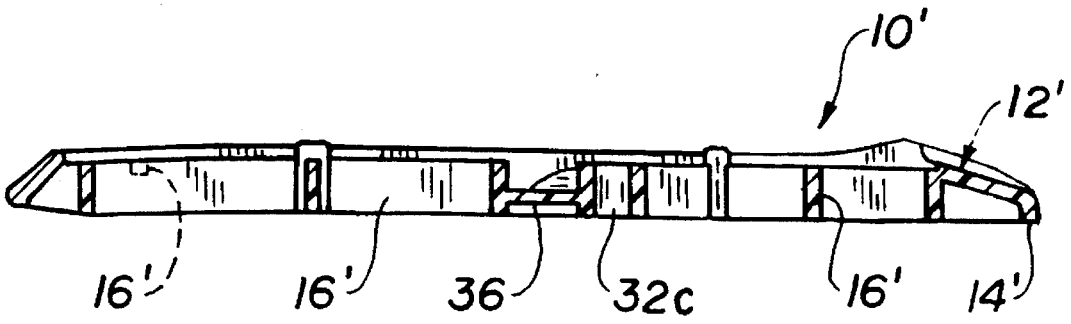
FIG. 6 is a longitudinal section taken through the embodiment in accordance with FIG. 5.

A second embodiment of the present invention is shown in FIGS. 5 and 6. This embodiment of the invention is adapted for use in conjunction with a ski binding turntable heel piece. In this respect, binding adapter plate 10' is positioned between the ski binding heel piece and the ski. Binding adapter plate 10' is comprised of a generally rectangular relatively inflexible outer structure or portion 14' and an inner structure or portion 12', which is flexible relative to outer portion 14'. Outer portion 14' provides stiff or rigid side walls that surround inner portion 12'. In this respect, outer portion 14' provides a relatively stiff frame which surrounds inner portion 12.

Inner portion 12' is generally comprised of a lattice-like structure having a plurality of ribs 16' and a plurality of holes 32*a*, 32*b* and 32*c* in the form of cylindrical bores. Ribs 16' have a height greater than their width. Accordingly, ribs 16' are perpendicular to the generally planar surface of binding adapter plate 10'. Holes 32*a*, 32*b* and 32*c*, receive fasteners for attaching binding adapter plate 10' and a ski binding to a ski. Holes 32*a*, 32*b* and 32*c* are connected to each other by ribs 16'. Ribs 16' also connect bores 32*a* and 32*b* to outer portion 14'. A strip 36 extends from cylindrical bore 32*c* to a rib 16' that extends transverse to the longitudinal direction of binding adapter plate 10'. Furthermore, the width of strip 36 is greater than its height. Accordingly, strip 36 is arranged parallel to the generally planar surface of binding adapter plate 10'.

The ribs 16' of inner portion 12' are arranged to allow inner portion 12' to move relative to outer portion 14' when the ski that binding adapter plate 10' is attached to is flexed. Accordingly, inner portion 12', including holes 32*a*, 32*b* and 32*c*, move relative to outer portion 14' as the ski bends. This reduces the stress placed upon fasteners, which extend through holes 32*a*, 32*b* and 32*c* to attach the binding adapter plate 10' and the ski binding to the ski. In this respect, the stress applied by the binding adapter plate to the fasteners extending through the holes, in response to the flexing of the ski, is reduced. Binding adapter plate 10' is preferably constructed of synthetic resin molding.

Figure 7:
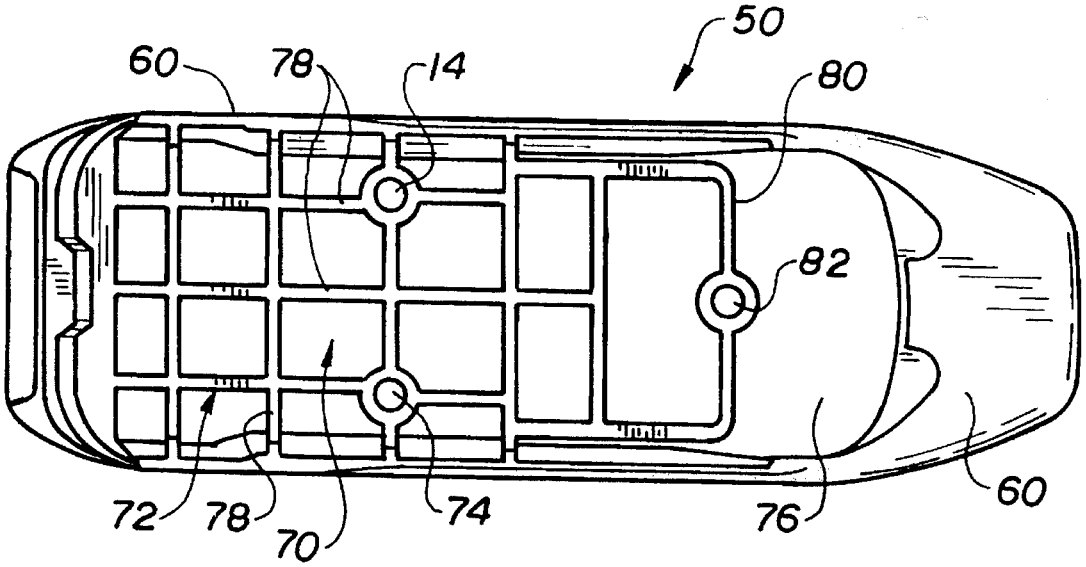
FIG. 7 is a top plan view of a third embodiment of a binding adapter plate in accordance with the present invention.
Figure 8:
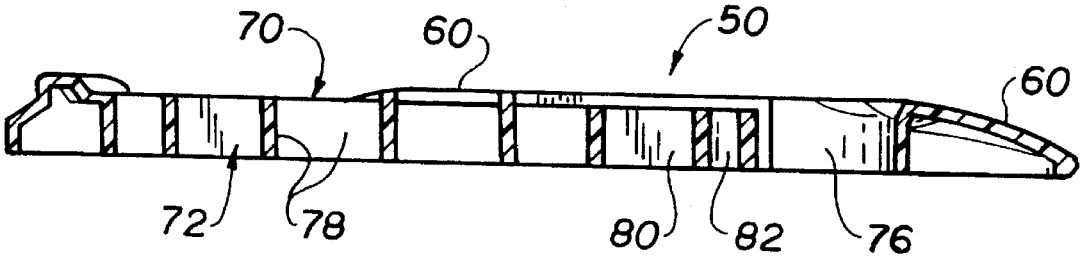
FIG. 8 is a longitudinal section taken through the embodiment in accordance with FIG. 7.

A third embodiment of the present invention is shown in FIGS. 7 and 8. This embodiment of the invention is adapted for use in conjunction with a ski binding toe piece. In this respect, binding adapter plate 50 is positioned between the ski binding toe piece and the ski. Binding adapter plate 50 is comprised of a relatively inflexible outer structure or portion 60 and an inner structure or portion 70 flexible relative to outer portion 60. Outer portion 60 is generally rectangular in shape and provides a relatively stiff or rigid outer frame surrounding inner portion 70.

Inner portion 70 is generally comprised of a lattice-like main body portion 72 and a lattice-like tongue portion 80. Tongue portion 80 is positioned within an opening 76 and is integrally connected via ribs to main body portion 72.

Both main body portion 72 and tongue portion 80 are comprised of ribs 78 having a height greater than their width. Accordingly, ribs 78 are perpendicular to the generally planar surface of binding adapter plate 50. Ribs 78 connect inner portion 70 to outer portion 60. A pair of holes 74 in the form of cylindrical bores are formed among ribs 78 of main body portion 72. A single hole 82, in the form of a cylindrical bore, is formed among ribs 78 of tongue portion 80. Holes 74 and 82 are dimensioned to receive a fastener for attaching the binding adapter plate 50 and a ski binding to a ski.

Ribs 78 of main body portion 72 and ribs 78 of tongue portion 80 are arranged to allow inner portion 70 to move relative to outer portion 60 when the ski to which binding adapter plate 50 is mounted flexes. Accordingly, holes 74 and hole 82 will move relative to outer portion 60, as the ski bends. This reduces the stress on fasteners which extend through the holes 74 and 82 to attach binding adapter plate 50 and the ski binding to the ski. As with the prior embodiments discussed above, binding adapter plate 50 is preferably constructed of synthetic resin molding.

The foregoing embodiments of the present invention also allow a ski binding to be mounted at a position higher above the surface of a ski. Accordingly, a skier can pivot the ski at a greater angle along the longitudinal axis of the ski. Thus, the present invention provides means by which a skier can obtain enhanced control of a ski.

The above described embodiments of the binding adapter plate are for employment as underlay plates or furthermore as binding guide plates. They participate in the bending of the ski to a very substantial extent without the fasteners extending through the binding adapter plates having to be subjected to a permanent load or stress owing to flexing of the ski. In this respect, the relatively flexible inner portion of the binding adapter plate is connected to the relatively inflexible or stiff outer portion of the binding adapter plate in a manner which allows the inner portion to move relative to the outer portion as the binding adapter plate is flexed in response to flexing of the ski, to relieve stress applied by the ski to the binding adapter plate.

The present invention has been described with reference to preferred embodiments. Other modifications and alterations will occur to those skilled in the art upon a reading and understanding of the present specification. It is intended that all such modifications and alterations be included insofar as they come within the scope of the appended claims or equivalents thereof.

What is claimed is:

1. A binding adapter plate for providing an intermediate layer between a ski and a ski binding mounted on the ski, said binding adapter plate comprising:

a relatively stiff outer structure;

a relatively flexible inner structure integrally connected to said outer structure, said inner Structure including one or more engaging surfaces for being engaged by fasteners to attach said plate and said ski binding to the ski, said engaging surfaces being flexible as said inner structure flexes, and connecting means for integrally connecting said outer structure to said inner structure, wherein said connecting means allows said outer structure to move in the longitudinal direction of the plate_, relative to the inner structure, as the binding adapter plate is flexed in response to flexing of the ski, to relieve stress applied by the ski to said fasteners.

2. The binding adapter plate of claim 1, wherein said device has a longitudinal axis and the inner structure is comprised of tongue means, wherein said connecting means connects said tongue means to said outer structure along a direction transverse to the longitudinal direction of said plate.

3. The binding adapter plate of claim 1, wherein said inner structure is comprised of a lattice-like portion and said connecting means are ribs which join said inner portion to said outer structure.

4. A binding adapter plate for providing an intermediate layer between a ski binding and the surface of a ski comprising:

a relatively stiff outer structure having a frame section and a generally planar section, said generally planar section having at least one fastener engaging surface for receiving a fastener for fastening said plate to said ski; and a relatively flexible inner structure integrally connected to said outer structure, said inner structure comprising:

tongue means integrally connected to said generally planar section and having at least one fastener engaging surface for engaging a fastener for fastening said binding adapter plate to said ski;

said inner structure being movable relative to said outer structure in the longitudinal direction of the plate, as the binding adapter plate is flexed in response to the flexing of the ski, when the ski bends to reduce stress applied by the ski to the fastener.

5. The binding adapter plate of claim 4, wherein said tongue means has a corrugated portion extending in a direction transverse to the longitudinal direction of the plate, and having a lateral component for increasing the flexibility of said inner structure.

6. The binding adapter plate of claim 4, wherein said generally planar section includes ribs.

7. The binding adapter plate of claim 4, wherein said binding adapter plate is formed of synthetic resin molding.

8. A binding adapter plate for providing an intermediate layer between a ski binding and the surface of a ski, said binding adapter plate comprising:

a relatively stiff outer portion for contributing to support the binding of the ski;

a relatively flexible inner portion, said inner portion integrally connected to said outer portion, and comprising:

a plurality of ribs dimensioned to have a height greater than their width, at least one strip dimensioned to have a width greater than its height, and a plurality of fastener engaging surfaces for engaging fasteners for fastening said binding adapter plate to said ski, said inner portion being movable relative to the outer portion in the longitudinal direction of the plate, as the binding adapter plate is flexed in response to the flexing of the ski, to relieve stress applied by the ski to the fasteners.

9. The binding adapter plate of claim 8, wherein said fastener engaging surfaces form a plurality of cylindrical bores.

10. The binding adapter plate of claim 9, wherein at least one of said plurality of cylindrical bores is connected to the outer portion by a rib.

11. The binding adapter plate of claim 9, wherein at least one of said plurality of cylindrical bores is connected to a rib by said at least one strip.

12. The binding adapter plate of claim 8, wherein said binding adapter plate is formed of synthetic resin molding.

13. A binding adapter plate for providing an intermediate layer between a ski binding and a ski, said binding adapter plate comprising:

a relatively stiff outer portion; and a relatively flexible inner portion integrally connected to said outer portion, said inner portion comprising:

a main body portion having a lattice structure and at least one fastener engaging surface for engaging a fastener for fastening said binding adapter plate to said ski, and a tongue means having a lattice structure and integrally connected to said main body portion and having at least one fastener engaging surface for engaging a fastener for fastening said binding adapter plate to said ski;

said inner portion being movable relative to said outer portion in the longitudinal direction of the plate, as the plate is flexed in response to the flexing of the ski, to relieve stress applied by the ski to the fasteners.

14. The binding adapter plate of claim 12 wherein said fastener engaging surface is in the form of a cylindrical bore.

* * * * *